US010624414B2

(12) United States Patent
Yang

(10) Patent No.: US 10,624,414 B2
(45) Date of Patent: Apr. 21, 2020

(54) ATHLETIC SKATE BODY

(71) Applicant: SAKURAI SPORTS MFG. CO., LTD., Kaohsiung (TW)

(72) Inventor: Hsin-Chih Yang, Kaohsiung (TW)

(73) Assignee: SAKURAI SPORTS MFG. CO., LTD., Kaohsiung (TW)

( * ) Notice: Subject to any disclaimer, the term of this patent is extended or adjusted under 35 U.S.C. 154(b) by 141 days.

(21) Appl. No.: 15/808,470

(22) Filed: Nov. 9, 2017

(65) Prior Publication Data

US 2019/0133247 A1 May 9, 2019

(51) Int. Cl.

| | |
|---|---|
| ***A43B 5/16*** | (2006.01) |
| ***A43B 13/38*** | (2006.01) |
| ***A43B 23/04*** | (2006.01) |
| ***A43C 11/12*** | (2006.01) |
| ***A43B 23/02*** | (2006.01) |
| ***A43B 23/07*** | (2006.01) |

(52) U.S. Cl.

CPC ..... *A43B 5/1683* (2013.01); *A43B 5/1666* (2013.01); *A43B 13/38* (2013.01); *A43B 23/021* (2013.01); *A43B 23/025* (2013.01); *A43B 23/0245* (2013.01); *A43B 23/042* (2013.01); *A43B 23/07* (2013.01); *A43C 11/12* (2013.01)

(58) Field of Classification Search

CPC ..... A43B 3/02; A43B 5/1666; A43B 5/1683; A43B 5/1691; A43B 13/38; A43B 23/042; A43C 11/12

USPC ..... 36/105, 47, 48, 49

See application file for complete search history.

(56) References Cited

U.S. PATENT DOCUMENTS

| | | | | | |
|---|---|---|---|---|---|
| 336,913 | A * | 3/1886 | Graff | A43B 3/14 | 36/11 |
| 1,453,950 | A * | 5/1923 | Puhakka | A43B 3/02 | 36/48 |
| 1,648,101 | A * | 11/1927 | Ascheim | A43C 11/12 | 36/50.1 |
| 2,068,811 | A * | 1/1937 | McCrory | A43B 3/02 | 36/45 |
| 2,109,566 | A * | 3/1938 | Fischer | A43B 5/1666 | 280/811 |
| 2,313,577 | A * | 3/1943 | Plant | A43C 11/008 | 36/50.1 |
| 2,494,964 | A * | 1/1950 | Rome | A43B 5/0486 | 36/117.1 |
| 2,526,831 | A * | 10/1950 | Schaeffler | A43B 5/00 | 36/117.9 |

(Continued)

*Primary Examiner* — Sharon M Prange

(74) *Attorney, Agent, or Firm* — Rabin & Berdo, P.C.

(57) ABSTRACT

An athletic skate body has an integrated leather vamp main body, a heel accessory piece, multiple strengthening pieces, a tongue, a shoe lining, an inner board, and a sole. The integrated leather vamp main body has a seamless toe box surface portion and a first lateral surface portion and a second lateral surface portion extending rearward from two sides of the toe box surface portion. The first and the second lateral surface portions are sewed with a heel accessory piece and thus a heel portion is formed. With the seamless toe box surface portion, strength of a head portion of the athletic skate body is enhanced, and a vamp base can be cut into shape by automation equipment. Thus, with the plane and integral vamp base attached with multiple strengthening pieces precisely, the manpower is saved and the quality of the athletic skate body is improved.

3 Claims, 10 Drawing Sheets

(56) References Cited

U.S. PATENT DOCUMENTS

| | | | | | |
|---|---|---|---|---|---|
| 2,883,771 | A * | 4/1959 | Sanchez | A43B 3/30 | 36/50.1 |
| 3,114,213 | A * | 12/1963 | Bowers | A43B 23/0245 | 36/48 |
| 3,378,940 | A * | 4/1968 | Potvin, Jr. | A43B 3/14 | 36/11 |
| 3,509,646 | A * | 5/1970 | Vietas | A43B 5/16 | 36/115 |
| 4,642,915 | A * | 2/1987 | Pfander | A43B 9/00 | 12/142 D |
| 4,726,126 | A * | 2/1988 | Bernhard | A43B 3/0031 | 36/89 |
| 6,272,773 | B1 * | 8/2001 | Sjosvard | A43B 5/006 | 36/131 |
| 6,484,420 | B1 * | 11/2002 | Chi | A43B 5/00 | 12/142 C |
| 7,021,663 | B1 * | 4/2006 | Moran | A43B 5/1666 | 280/11.12 |
| 7,197,840 | B2 * | 4/2007 | Nakano | A43B 7/144 | 12/142 B |
| 2007/0204485 | A1 * | 9/2007 | Kilgore | A43B 23/0235 | 36/47 |
| 2007/0245595 | A1 * | 10/2007 | Chen | A43B 7/08 | 36/45 |
| 2014/0047736 | A1 * | 2/2014 | Lehmkuhler | A43B 11/00 | 36/50.1 |

* cited by examiner

ATHLETIC SKATE BODY

BACKGROUND OF THE INVENTION

1. Field of the Invention

The present invention relates to an athletic skate body, especially to an athletic skate body that is capable of being mounted with a blade seat or a wheel seat.

2. Description of the Prior Arts

Skate bodies of conventional ice skates, inline skates, or roller skates can be classified into shell-type skate bodies or leather-type skate bodies. As shown in FIG. 10, the leather-type athletic skate body 30 includes a first vamp piece 311 and a second vamp piece 312 respectively made of two leathers cut in a pre-set shape and size in advance. Front edges and rear edges of the first vamp piece 311 and the second vamp piece 312 are connected by stitches 313, and thus a leather vamp main body 31 is formed. A toe box surface portion 310 on a front end of the leather vamp main body 31 and a heel portion 314 on a rear end of the leather vamp main body 31 respectively comprise sewed portions. A tongue 32 is sewed on a rear edge of a top portion of the toe box surface portion 310. One or multiple strengthening pieces are attached to an inner surface of the leather vamp main body 31, and a shape of each one of the strengthening pieces is designed according to a shape of the skate body. After that, a shoe lining 33 is attached or sewed on the inner surface of the leather vamp main body 31, which causes the shoe lining 33 to cover said inner surface of the leather vamp main body 31 and outer surfaces of the strengthening pieces. After an inner board and a sole 34 are mounted on a bottom end of the leather vamp main body 31, a leather-type athletic skate body 30 is manufactured. Furthermore, after a blade seat or a wheel seat is mounted on a bottom of a sole portion of the leather-type athletic skate body 30, an ice skate, an inline skate, or a roller skate is manufactured.

However, the conventional leather-type athletic skate body is made of two pieces of leather (e.g. the first vamp piece 311 and the second vamp piece 312) combined by sewing at front edges and rear edges respectively. Therefore, the skate body is made with two stitches manually, so a manufacture process is complicated and consumes a lot of time. Besides, portions sewed with the stitches are curved, so the manufacture is difficult, and the strengthening pieces need to be attached to the inner surface of the leather vamp main body after the two stitches are sewed on the leather vamp main body. Because the leather vamp main body is shaped in three dimensions, attaching the strengthening pieces is constrained by space, making the work complicated and the strengthening piece not located precisely. Therefore, with such constraints in the manufacture process, the conventional leather-type athletic skate body is hard to be manufactured in an automated way.

Besides, a head portion of the conventional leather-type athletic skate body is combined of two leather pieces, such as a first vamp piece and a second vamp piece. Because front edges of the leather pieces are aligned and combined by sewing to form the head portion, it is not aesthetic when stitches are visible in a middle of the head portion, and the stitches in the middle of the head portion may be broken easily, which causes the first vamp piece and the second vamp piece to be separated and the skate body cannot be normally used.

To overcome the shortcomings, the present invention provides an athletic skate body to mitigate or obviate the aforementioned problems.

SUMMARY OF THE INVENTION

The main objective of the present invention is to provide an athletic skate body that.

The athletic skate body has an integrated leather vamp main body, a heel accessory piece, a plurality of strengthening pieces, a tongue, a shoe lining, an inner board, and a sole. The integrated leather vamp main body is made of a single bent vamp piece, and rear edges of the vamp piece aligned and sewed with each other. The integrated leather vamp main body includes a seamless toe box surface portion, a first lateral surface portion and a second lateral surface portion, a heel portion, and a top opening. The first lateral surface portion and the second lateral surface portion extend respectively rearward from a right side and a left side of the toe box surface portion. The heel portion is formed via rear edges of the first lateral surface portion and the second lateral surface portion are aligned and combined together, and thus the heel portion in formed on a rear end of the integrated leather vamp main body. The top opening is formed between a rear edge of the toe box surface portion and top edges of the first lateral surface portion, the second lateral surface portion, and the heel portion. The heel accessory piece is sewed on an outer surface of the heel portion and covers a combining portion of the rear edges of the first lateral surface portion and the second lateral surface portion. The strengthening pieces are attached to an inner side of the integrated leather vamp main body. The tongue is mounted in the top opening of the integrated leather vamp main body, and a front edge of the tongue is sewed on and connected with a rear edge of the toe box surface portion. The shoe lining is securely mounted on an inner surface of the integrated leather vamp main body and covers the inner surface of the integrated leather vamp main body and the strengthening pieces. The inner board is securely mounted on a bottom edge of the integrated leather vamp main body. The sole is securely mounted on the bottom edge of the integrated leather vamp main body and a bottom surface of the inner board.

The aforementioned athletic skate body has advantages at least as followings:

1. Ease in automated manufacture: with a special structure of the integrated leather vamp main body of the present invention, a vamp base can be cut in a pre-set size as a whole by automation equipment, and the plane and integral vamp base can be attached with multiple strengthening pieces precisely and sewed with a tongue. After that, rear edges of the integrated leather vamp main body are aligned and combined with each other with stitches. Therefore, the athletic skate body can be manufactured in an automated way, save manpower, and increase manufacture capacity.

2. Strength enhancement of a head portion: the integrated leather vamp main body of the present invention includes a seamless toe box surface portion, a first lateral surface portion, and a second lateral surface portion. The first and the second lateral surface portions extend rearward from the right side and the left side of the toe box surface portion. Rear edges of the first lateral surface portion and second lateral surface portion are aligned and combined with each other and thus a heel portion is formed. Therefore, after the integrated leather vamp main body is shaped, there is no stitch in the middle of the toe box surface portion, which improves a strength of the toe box. The problem that stitches in a middle of a conventional toe box are broken easily is thus overcome.

3. Improved quality: being seamless in the middle of the toe box surface portion of the integrated leather vamp main body of the present invention, the athletic skate body is more aesthetic and elegant. With the vamp base is cut into a pre-set size as a whole by automation equipment and the plane and integral vamp base are attached with multiple strengthening pieces precisely and sewed with a tongue, the quality of the athletic skate body is improved.

Other objectives, advantages and novel features of the invention will become more apparent from the following detailed description when taken in conjunction with the accompanying drawings.

BRIEF DESCRIPTION OF THE DRAWINGS

FIG. 5 is a perspective view of the vamp base of the athletic skate body in

FIG. 4, showing that the vamp base is sewed and forms an integrated leather vamp main body with a tongue;

DETAILED DESCRIPTION OF THE PREFERRED EMBODIMENTS

Figure 1:
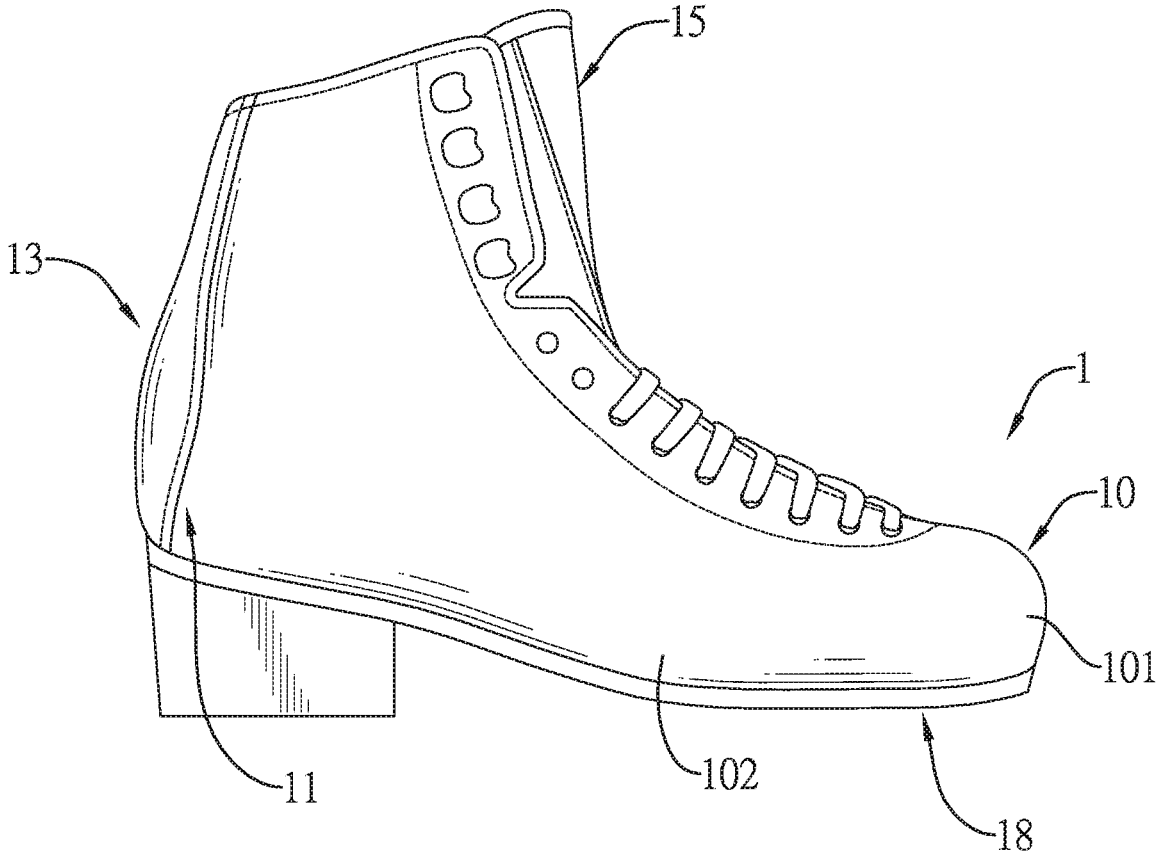
FIG. 1 is a side view of an athletic skate body of a preferred embodiment in accordance with the present invention.
Figure 2:
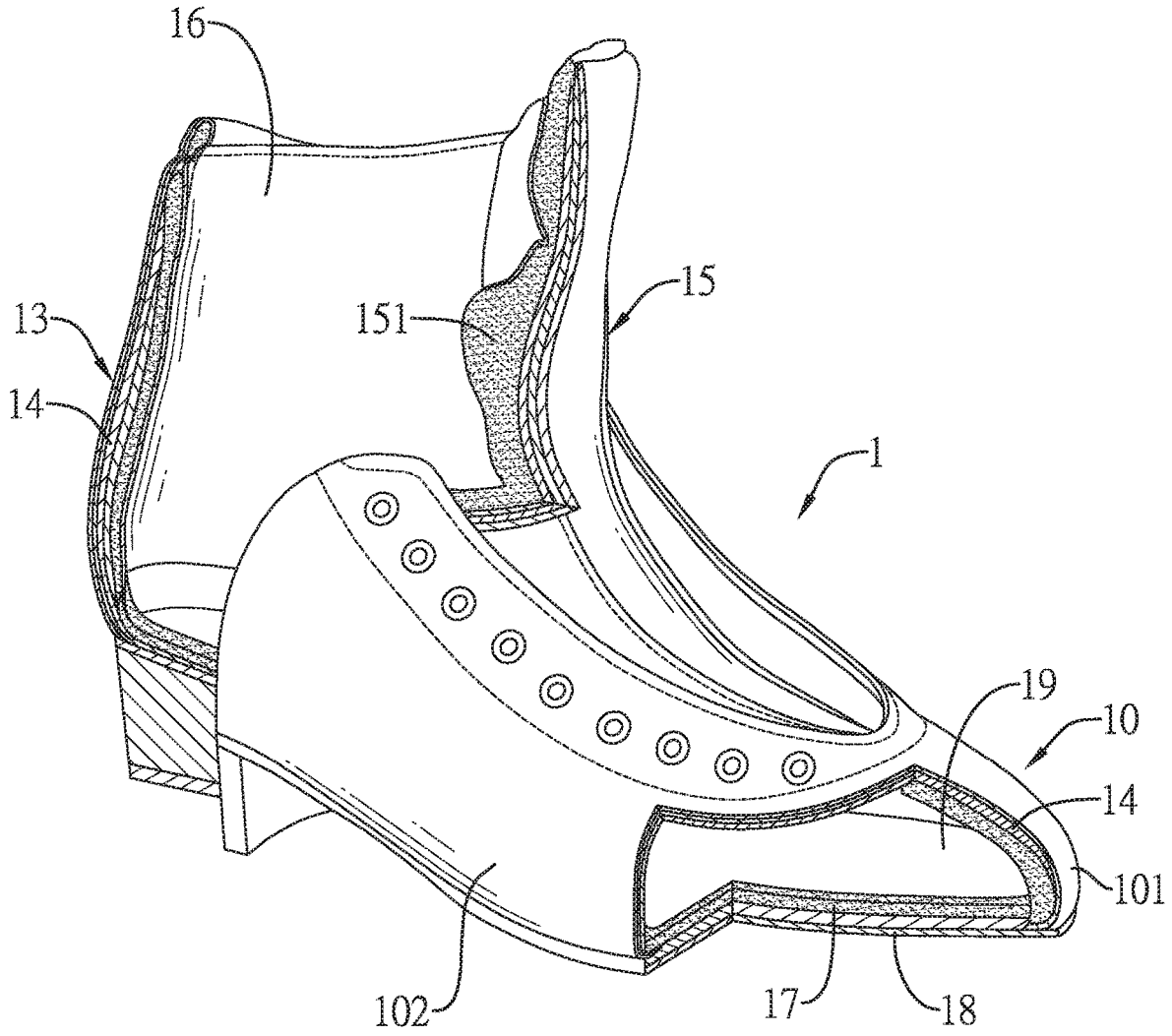
FIG. 2 is a partial sectional view of the athletic skate body in FIG. 1.

With reference to FIGS. 1 and 2, a preferred embodiment of an athletic skate body 1 in accordance with the present invention is provided and includes an integrated leather vamp main body 10, a heel accessory piece 13, a plurality of strengthening pieces 14, a tongue 15, a shoe lining 16, an inner board 17, and a sole 18.

Figure 3:
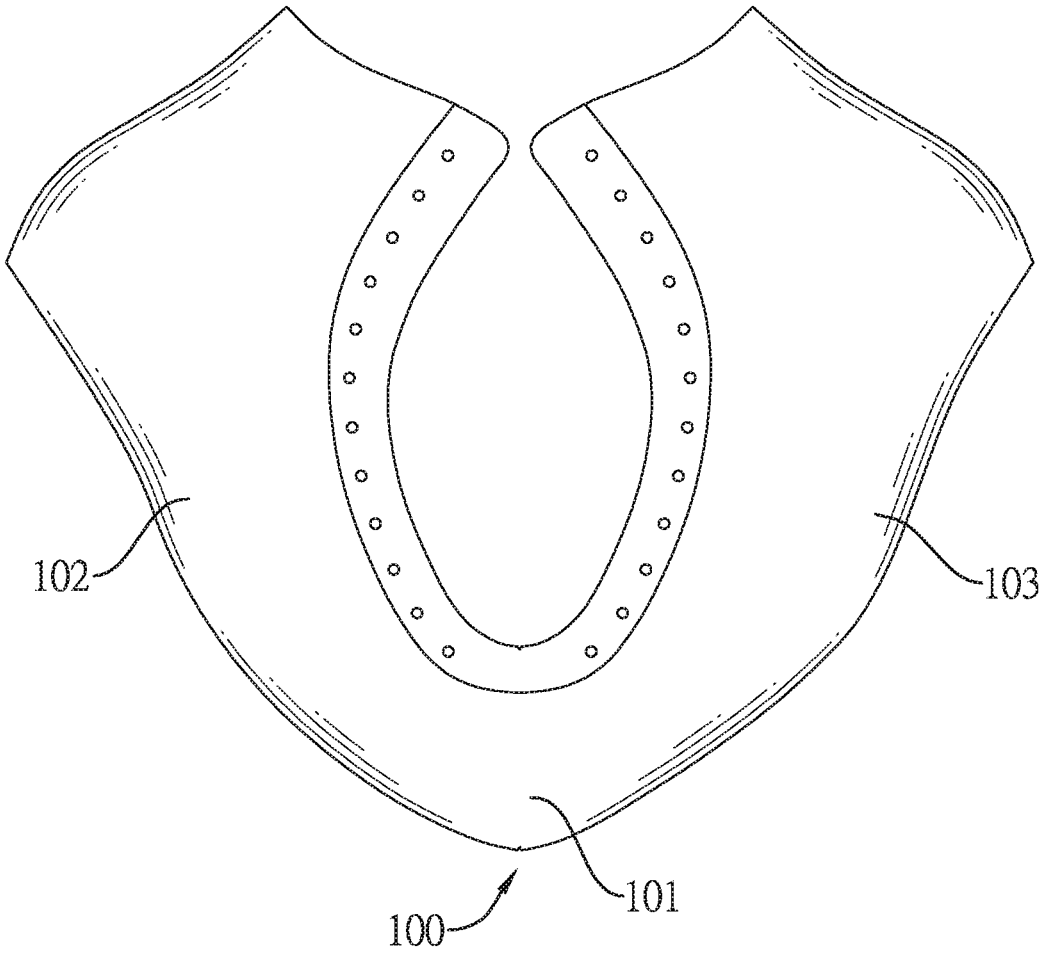
FIG. 3 is an expanded view of a vamp base of the athletic skate body in FIG. 1.
Figure 5:
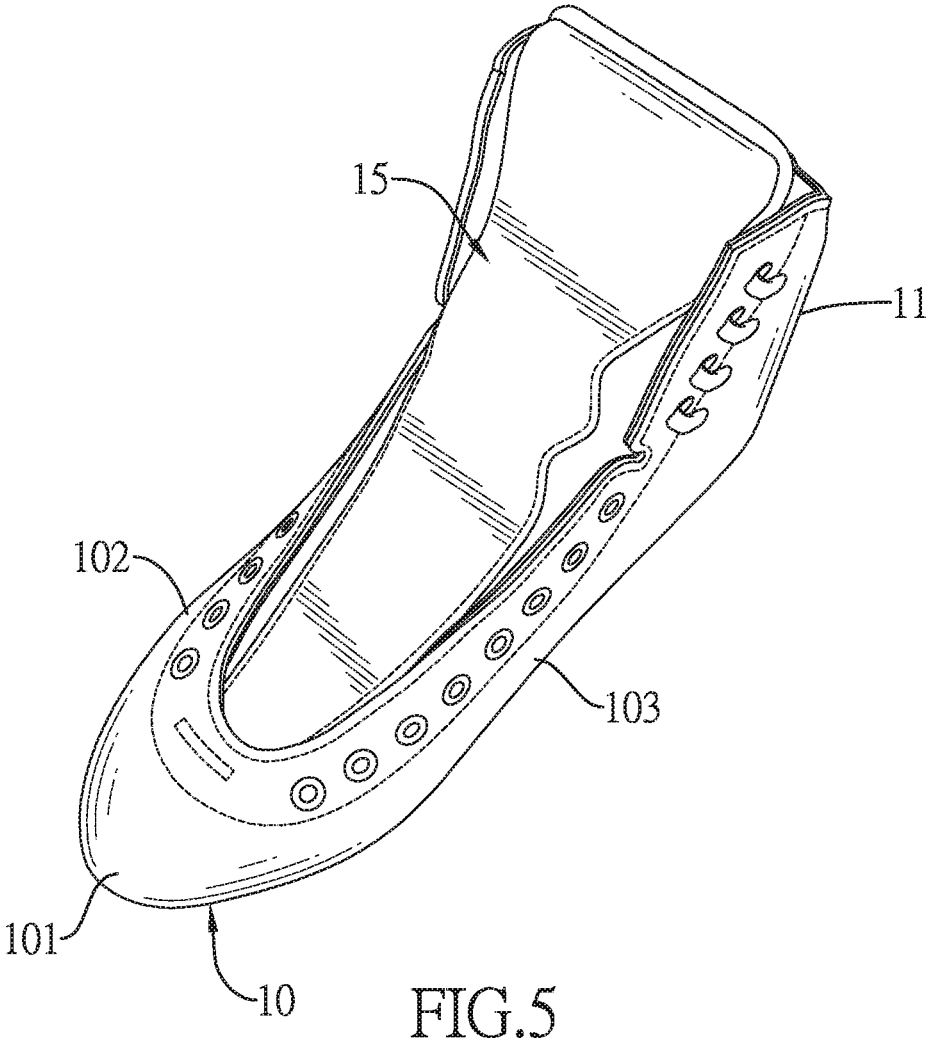

Please refer to FIGS. 2, 3, and 5. The integrated leather vamp main body 10 is formed from a bent single vamp base 100 by folding the vamp base 100 to align rear edges of the vamp base 100 and sewing the rear edges together. The vamp base 100 is made of leather and cut into a pre-set shape. The integrated leather vamp main body 10 includes a toe box surface portion 101, a first lateral surface portion 102, a second lateral surface portion 103, a heel portion 11, and a top opening. The toe box surface portion 101 is formed seamlessly. The first lateral surface portion 102 and the second lateral surface portion 103 extend rearward from a right side and a left side of the toe box surface portion 101. The heel portion 11 is formed by aligning and combining rear edges of the first lateral surface portion 102 and the second lateral surface portion 103. The top opening is formed between a rear edge of the toe box surface portion 101 and top edges of the first lateral surface portion 102, the second lateral surface portion 103, and heel portion 11.

As shown in FIGS. 2, 3, 6A, and 6B, after the rear edges of the first lateral surface portion 102 and the second lateral surface portion 103 are aligned with each other, said edges may be combined together as a whole by sewing and thus the heel portion 11 becomes a fixed heel portion. On the other hand, as shown in FIGS. 7A and 7B, after the rear edges of the first lateral surface portion 102 and second lateral surface portion 103 are aligned with each other, lower segments of the rear edges of the first lateral surface portion 102 and the second lateral surface portion 103 are sewed with a stitch as a whole, and upper segments of the first lateral surface portion 102 and the second lateral surface portion 103 are sewed with a zipper 12, so that the heel portion 11A can be opened and closed with the zipper 12.

Figure 6B:
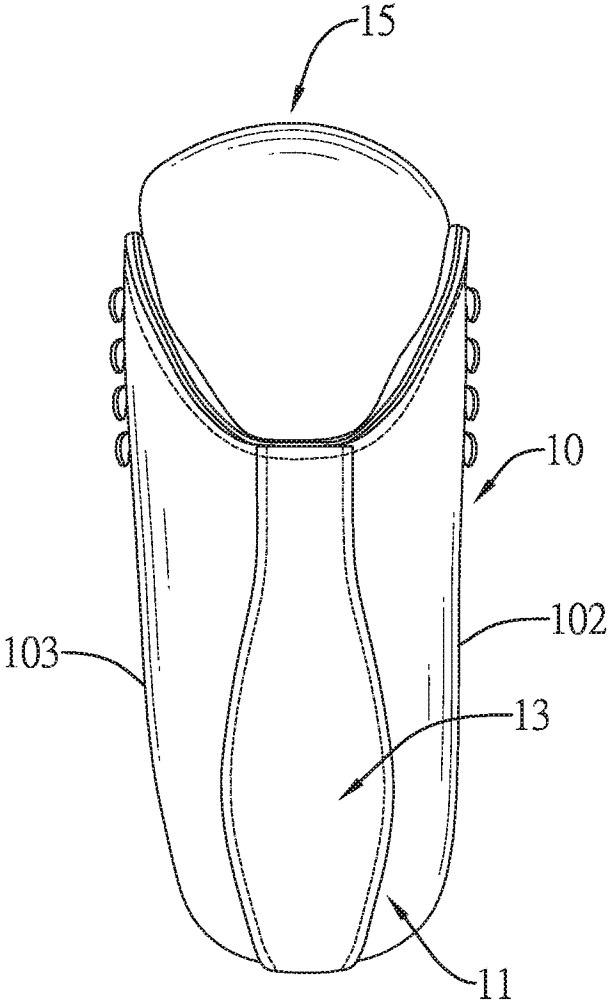
FIG. 6B is a rear view of the integrated leather vamp main body of the athletic skate body in FIG. 5, shown with a heel accessory piece sewed on a heel portion of the integrated leather vamp main body.
Figure 6A:
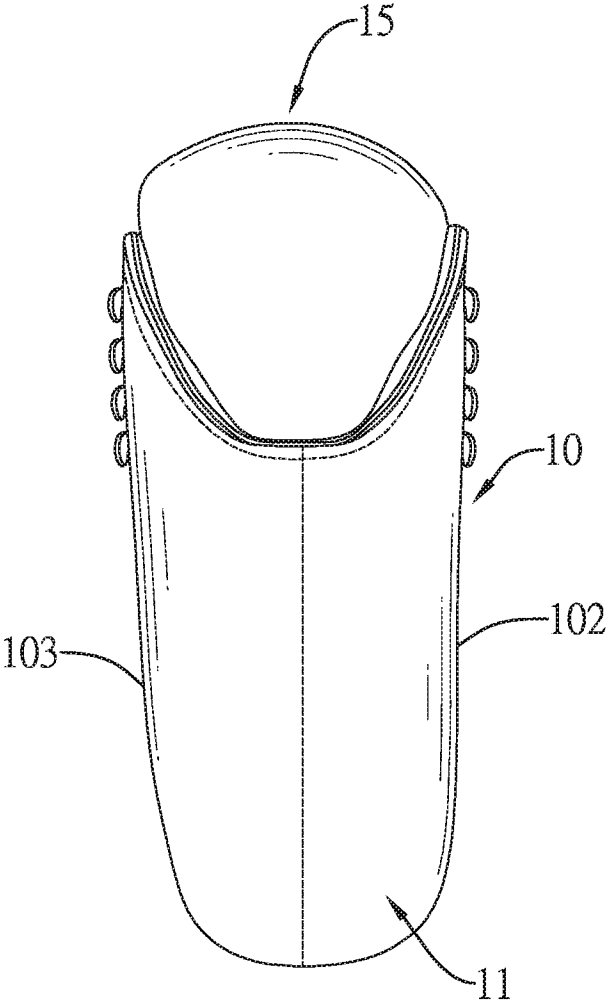
FIG. 6A is a rear view of the integrated leather vamp main body of the athletic skate body in FIG. 5.
Figure 7B:
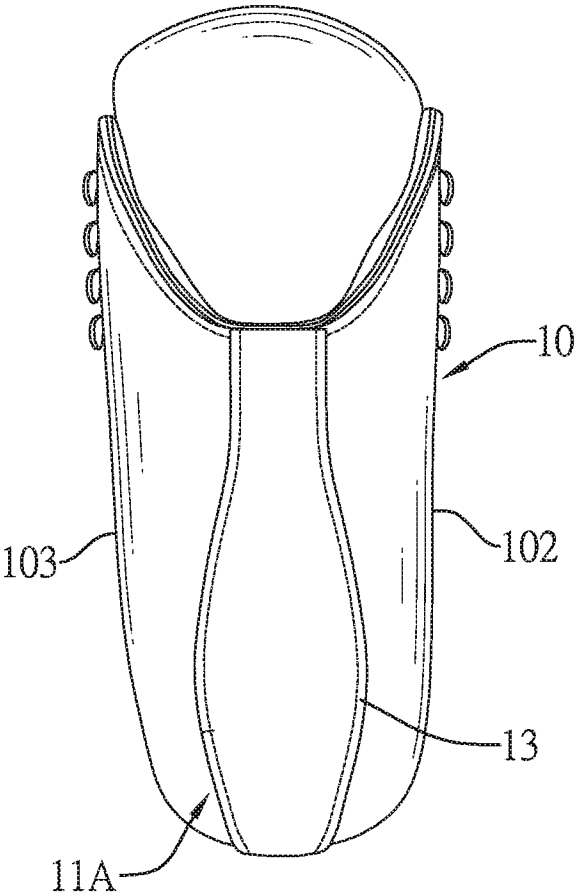
FIG. 7B is a rear view of the integrated leather vamp main body of the athletic skate body in FIG. 7B, shown with a zipper and a heel accessory piece sewed on a heel portion of the integrated leather vamp main body.
Figure 7A:
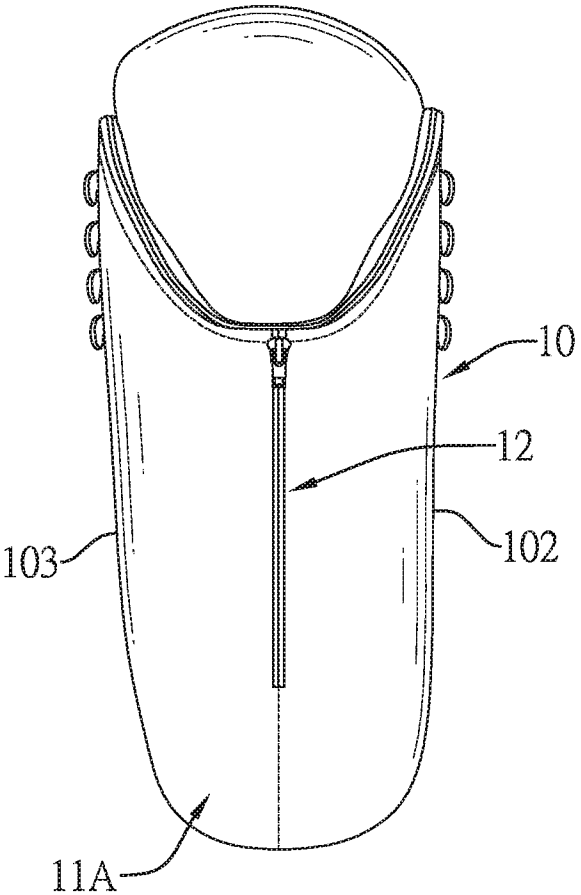
FIG. 7A is a rear view of the integrated leather vamp main body of another embodiment of the athletic skate body.
Figure 8:
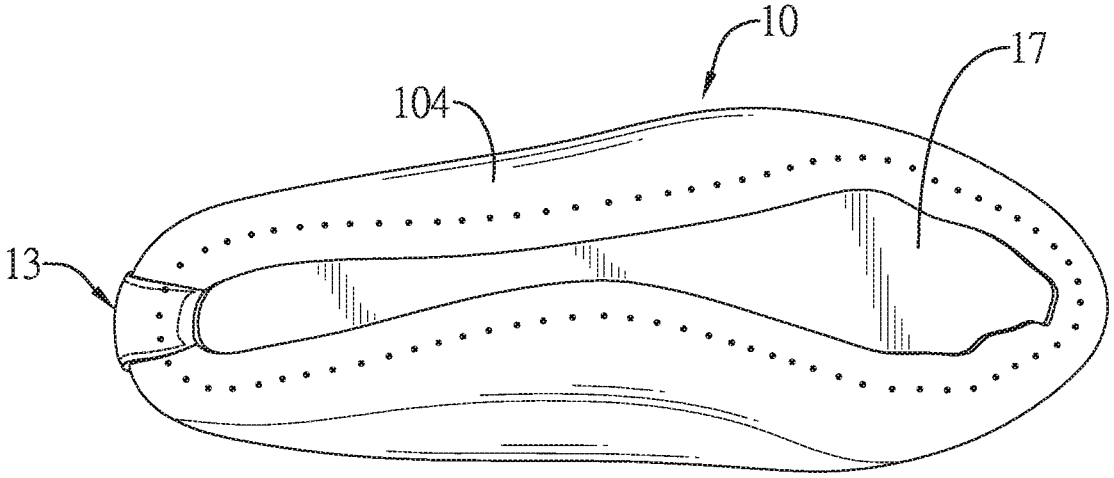
FIG. 8 is a bottom view of the integrated leather vamp main body of the athletic skate body in FIG. 5, showing an inner board mounted on a bottom of the integrated leather vamp main body.

As shown in FIGS. 2, 6A, and 6B, the heel accessory piece 13 is sewed and fixed on an outer surface of the heel portion 11 on a rear end of the integrated leather vamp main body 10 and covers a combined portion of the rear edges of the first lateral surface portion 102 and the second lateral surface portion 103. In the configuration that the heel portion 11 is a fixed heel portion fully sewed as a whole, the heel accessory piece 13 is entirely sewed and fixed on the outer surface of the heel portion 11. As shown in FIGS. 2, 7A, and 7B, in the configuration that the heel portion 11A comprises the zipper 12 as the heel portion 11A capable of being opened and closed, a part of the heel accessory piece 13 is sewed and fixed on the outer surface of the heel portion 11A and a remaining part of the heel accessory piece 13 is capable of being flipped sideward, so that a surface of the heel portion 11A corresponding to a side of the heel accessory piece 13 can be exposed.

Figure 4:
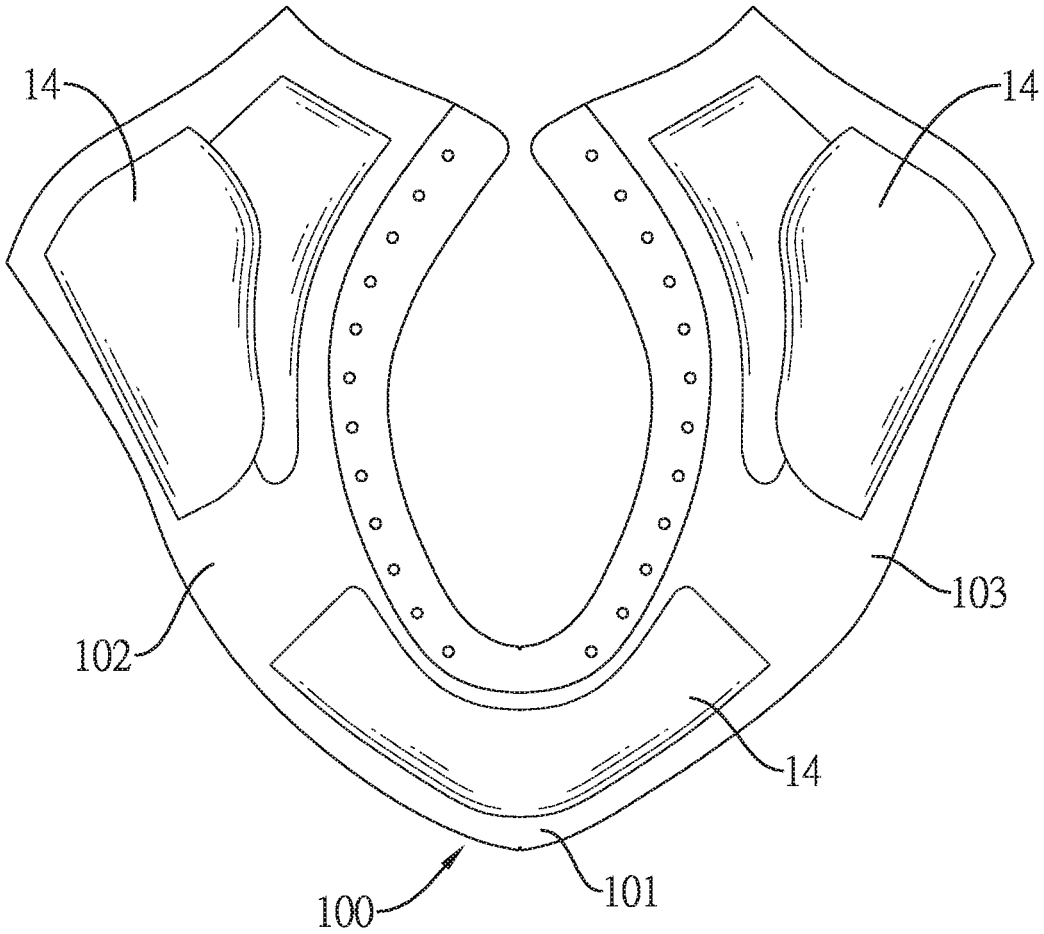
FIG. 4 is an expanded view of the vamp base of the athletic skate body in FIG. 3, showing with strengthening pieces attached to an inner surface.

As shown in FIGS. 2 and 4, shapes of the plurality of strengthening pieces 14 are designed according to a shape of the athletic skate body, and thus the strengthening pieces are selectively attached to inner surfaces of the toe box surface portion 10, the first lateral surface portion 102, the second lateral surface portion 103, or the heel portion 11, 11A, which strengthens particular parts of the integrated leather vamp main body 10. The strengthening pieces 14 are attached either in one layer or multiple layers for fitting a contour of a human foot.

As shown in FIGS. 1, 2, and 5, the tongue 15 is mounted in the top opening of the integrated leather vamp main body 10. Precisely, a front edge of the tongue 15 is sewed on and connected with the rear edge of the toe box surface portion 101. The tongue 15 has a tongue lining 151 on an inner surface of the tongue 15.

As shown in FIG. 2, the shoe lining 16 is made of a soft material, is fixed on the inner surface of the integrated leather vamp main body 10, and covers the strengthening pieces 14 and the inner surface of the integrated leather vamp main body 10.

As shown in FIG. 2, a shape of the inner board 17 is made according to a shape of a bottom of the integrated leather vamp main body 10. The inner board 17 is fixed on the bottom of the integrated leather vamp main body 10. The bottom of the integrated leather vamp main body 10 is bent inward and includes a securing edge 104. The securing edge 104 and the inner board 17 are attached together and further fixed by a fastening means, e.g. nails.

As shown in FIGS. 1 and 2, the sole 18 is securely mounted on the bottom of the integrated leather vamp main body 10 and a bottom surface of the inner board 17. In this embodiment, the sole 18 is attached to and sewed on the bottom of the integrated leather vamp main body 10 and the bottom surface of the inner board 17.

As shown in FIG. 2, the athletic skate body 1 may further comprise a tender insole 19 therein on the inner board 17.

Figure 9:
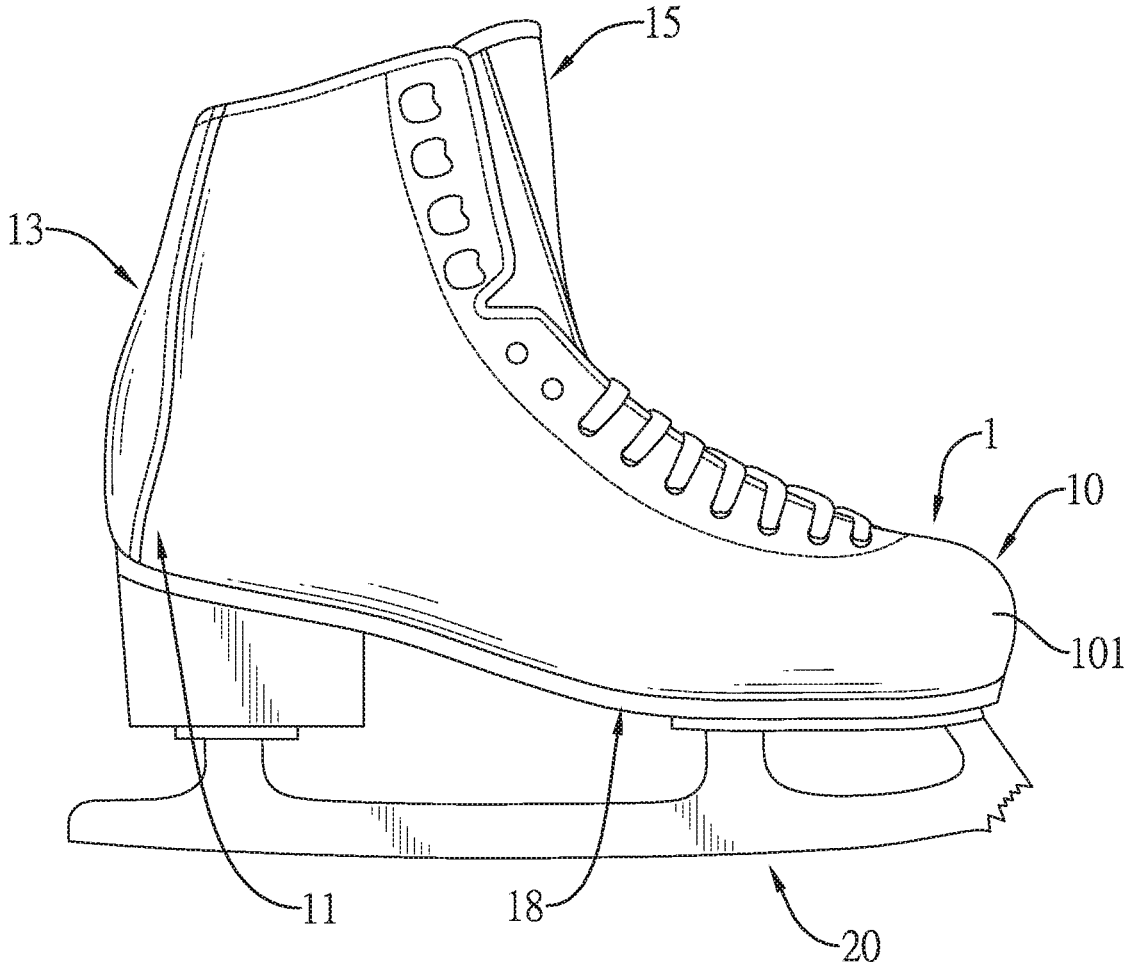
FIG. 9 is a side view of the athletic skate body in FIG. 1, shown with a blade seat.
Figure 10:
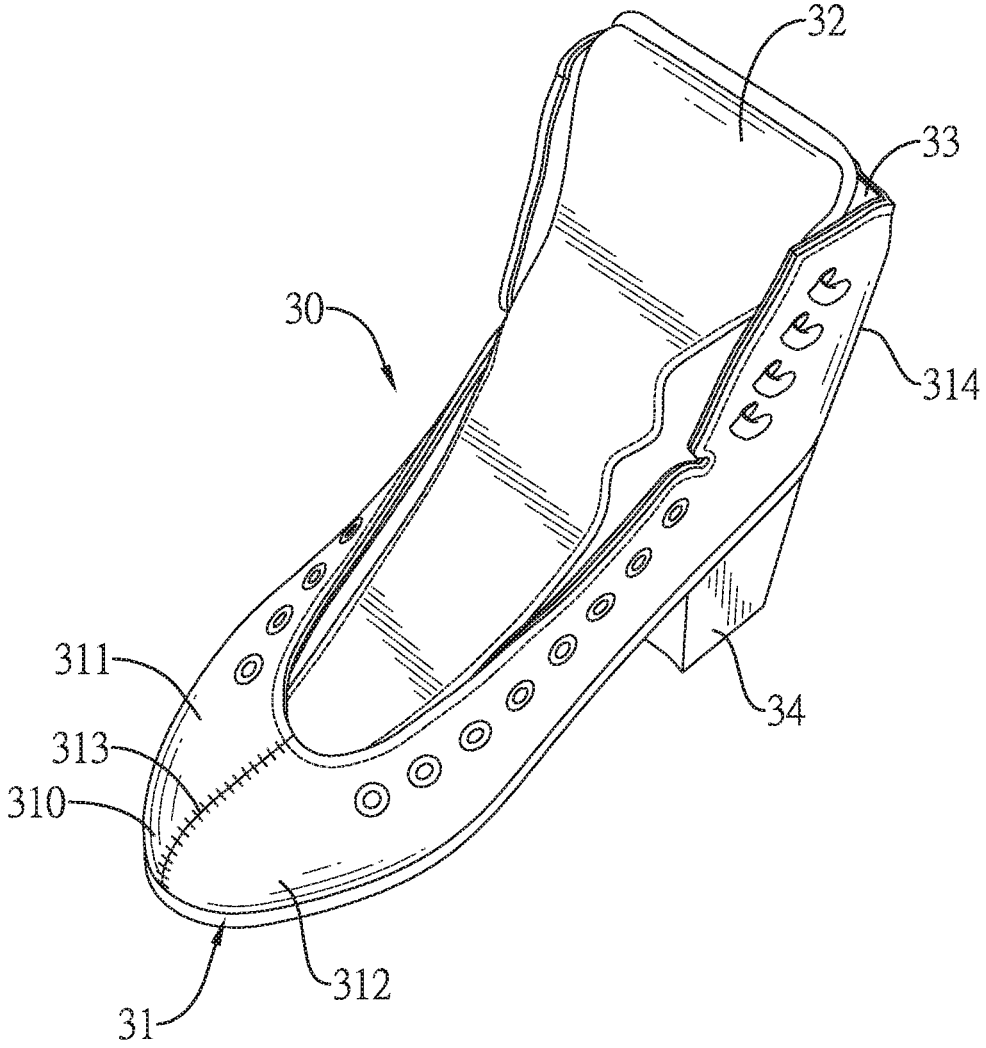
FIG.10 PRIOR ART
FIG. 10 is a perspective of a conventional leather-type athletic skate body.

In a manufacture process of the aforesaid athletic skate body of the present invention, as shown in FIGS. 3 and 4, the vamp base 100 may be produced integrally and cut into a pre-set size via automation equipment, and the plane and integral vamp base 100 can be adhered with the strengthening piece 14 and sewed with the tongue 15, etc. Then, rear edges of the integrated leather vamp main body 10 are aligned and sewed together with stitches as shown in FIGS. 5, 6A, and 6B, or further sewed with a zipper 12 as shown in FIGS. 7A and 7B. Then, as shown in FIG. 5, the shoe lining 16 is sewed in the integrated leather vamp main body 10, and then a plurality of shoelace eyelets are fixed on the integrated leather vamp main body 10. As shown in FIGS. 1 and 2, after the inner board 17 is disposed on a bottom of a shoe last, the integrated leather vamp main body 10 covers the shoe last to process lasting. Then the sole 18 is attached to the bottom of the integrated leather vamp main body 10 and the bottom surface of the inner board 17 and thus the athletic skate body is manufactured. As shown in FIG. 9, a bottom surface of the sole of the athletic skate body 1 may be mounted with a blade seat 20 or a wheel seat so that an athletic skate is manufactured.

According to the aforementioned description, the main concept of the present invention is that the athletic skate body comprises an integrated leather vamp main body including a vamp base produced integrally and cut into a pre-set size via automation equipment. Therefore, the plane and integral vamp base can be attached with multiple strengthening pieces precisely and sewed with a tongue, and then the rear edges of the integrated leather vamp main body are aligned with each other and sewed together with stitches. Thus, the athletic skate body can be manufactured by automation equipment, so the manpower may be reduced and a capacity and efficiency of production may be improved. Furthermore, the integrated leather vamp main body of the present invention has a seamless toe box surface portion, and a first lateral surface portion and a second lateral surface portion extending rearward from two sides of the toe box surface portion. Rear edges of the first lateral surface portion and the second lateral surface portion are aligned and combined together, so that a heel portion is formed. Therefore, after the integrated leather vamp main body is shaped, there is no stitch in the middle of the toe box surface portion and thereby not only the shape of the skate is more aesthetically appealing, but also strength of the toe box is enhanced. The problem that stitches in a middle of a conventional toe box are broken easily is thus overcome.

Consequently, with a special structure of the integrated leather vamp main body, the integrated leather vamp main body can be cut as a plane vamp base, adhered with the strengthening piece precisely, and sewed with the tongue, aligned and sewed the rear edges thereof together or sewed with a zipper parts on the rear edges thereof by automation equipment. Therefore, the athletic skate body of the present invention may be manufactured in an automated process, so that the manufacture capacity of the athletic skate body is increased and the quality of the athletic skate bodies is stable. Besides, with the special structure of the integrated leather vamp main body, the toe box is seamless in the middle thereof, so that aesthetic and strength are enhanced. Thus, an athletic skate body of the present invention is highly valuable in industrial utilization in the field of shoe manufacture.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. An athletic skate body including:

an integrated leather vamp main body made of a single bent vamp piece; the integrated leather vamp main body including:

a seamless toe box surface portion;

a first lateral surface portion and a second lateral surface portion extending respectively rearward from a right side and a left side of the toe box surface portion; rear edges of the first lateral surface portion and the second lateral surface portion aligned and combined with each other to form a heel portion, which is on a rear end of the integrated leather vamp main body; lower segments of the rear edges of the first lateral surface portion and the second lateral surface portion being sewed and combined with stitches as a whole; and a top opening formed between a rear edge of the toe box surface portion and top edges of the first lateral surface portion, the second lateral surface portion, and the heel portion;

a zipper sewed on upper segments of the rear edges of the first lateral surface portion and the second lateral surface portion, the heel portion thereby being capable of being opened and closed with the zipper;

a heel accessory piece, a portion of the heel accessory piece being sewed and fixed on an outer surface of the heel portion and covering a combining portion of the rear edges of the first lateral surface portion and the second lateral surface portion;

one side of the heel accessory piece being capable of exposing the zipper, said side of the heel accessory piece being opposite the heel portion;

a plurality of strengthening pieces attached to an inner side of the integrated leather vamp main body;

a tongue mounted in the top opening of the integrated leather vamp main body, a front edge of the tongue being sewed on and connected with the rear edge of the toe box surface portion;

a shoe lining securely mounted on an inner surface of the integrated leather vamp main body and covering the inner surface of the integrated leather vamp main body and the strengthening pieces;

an inner board securely mounted on a bottom edge of the integrated leather vamp main body; and a sole securely mounted on the bottom edge of the integrated leather vamp main body and a bottom surface of the inner board.

2. The athletic skate body as claimed in claim 1, wherein the integrated leather vamp main body further includes:

a plurality of shoelace holes located on the first lateral surface portion and the second lateral surface portion and near the top opening.

3. The athletic skate body as claimed in claim 1, wherein the bottom of the integrated leather vamp main body is bent inward and includes:

a securing edge attached to the inner board or fixed on the inner board by fixing components.

* * * * *